US006659461B2

(12) United States Patent
Yoseloff et al.

(10) Patent No.: US 6,659,461 B2
(45) **Date of Patent: *Dec. 9, 2003**

(54) METHOD OF PLAYING A TABLE CARD GAME WITH AN ELECTRONIC MULTIPLIER BONUS FEATURE AND APPARATUS FOR PLAYING THE GAME

(75) Inventors: Mark L. Yoseloff, Henderson, NV (US); Russell B. Dunn, Henderson, NV (US); Ferdinand Paul Lychock, Jr., Las Vegas, NV (US); Timothy S. Wasinger, Fort Collins, CO (US); Walter J. Crowley, Greeley, CO (US)

(73) Assignee: Shuffle Master, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/967,460

(22) Filed: Sep. 28, 2001

(65) Prior Publication Data

US 2002/0074726 A1 Jun. 20, 2002

Related U.S. Application Data

(63) Continuation-in-part of application No. 09/394,748, filed on Sep. 13, 1999.

(51) Int. Cl.[7] ..... A63F 3/08
(52) U.S. Cl. ..... 273/274; 463/20; 463/25
(58) Field of Search ..... 273/274, 143 R, 273/138.2; 463/9, 16, 17, 20, 25

(56) References Cited

U.S. PATENT DOCUMENTS

| | | | | |
|---|---|---|---|---|
| 4,648,600 A | * | 3/1987 | Olliges | 463/20 |
| 4,836,553 A | | 6/1989 | Suttle et al. | |
| 4,861,041 A | | 8/1989 | Jones et al. | |
| 5,019,973 A | | 5/1991 | Wilcox et al. | |
| 5,033,744 A | | 7/1991 | Bridgeman et al. | |
| 5,042,818 A | * | 8/1991 | Weingardt | 463/13 |
| 5,067,712 A | * | 11/1991 | Georgilas | 463/21 |
| 5,098,107 A | | 3/1992 | Boylan et al. | |
| 5,154,429 A | | 10/1992 | LeVasseur | |
| 5,259,616 A | * | 11/1993 | Bergmann | 463/17 |
| 5,275,411 A | | 1/1994 | Breeding | |
| 5,288,077 A | | 2/1994 | Jones | |
| 5,288,081 A | | 2/1994 | Breeding | |
| 5,332,219 A | | 7/1994 | Marnell, II et al. | |
| 5,364,105 A | | 11/1994 | Jones | |

(List continued on next page.)

FOREIGN PATENT DOCUMENTS

| | | |
|---|---|---|
| DE | 37 00 861 | 7/1988 |
| DE | 40 14 477 A1 | 7/1991 |
| GB | 2 072 395 | 9/1981 |
| GB | 2 322 217 | 8/1988 |
| GB | 2 201 821 | 9/1988 |
| GB | 2 202 984 | 10/1988 |
| WO | WO 99/42186 | 8/1999 |
| WO | WO 00/43087 | 7/2000 |

*Primary Examiner*—Benjamin H. Layno
*Assistant Examiner*—Dolores R Collins
(74) *Attorney, Agent, or Firm*—Mark A. Litman & Assoc. P.A.

(57) ABSTRACT

A method of playing a casino table card game with a bonus event has a player placing a first wager on a casino table card game; providing a hand of cards to the player; determining if the hand of cards provided to a player is within a definition of specific triggering events; if the hand is determined to be within the definition of specific triggering events, allowing the player to enter a bonus game; the player enters at least one bonus game where a random symbol is displayed on a visual display device associated with the casino table, the random symbols identifying an award of an absolute amount of value or a factor that is used to increase a base amount; and resolving all wagers and awards for the player. An apparatus for implementing the method is also shown.

27 Claims, 2 Drawing Sheets

U.S. PATENT DOCUMENTS 5,377,973 A 1/1995 Jones et al.
5,393,057 A 2/1995 Marnell, II
5,393,061 A 2/1995 Manship et al.
5,409,225 A * 4/1995 Kelly et al. ..... 273/118 A
5,431,407 A 7/1995 Hofberg et al.
5,449,173 A * 9/1995 Thomas et al. ..... 273/143 R
5,452,899 A 9/1995 Skratulia et al.
5,494,287 A 2/1996 Manz
5,511,781 A 4/1996 Wood et al.
5,529,309 A 6/1996 Bartlett
5,531,440 A 7/1996 Dabrowski et al.
5,531,441 A 7/1996 Dabrowski et al.
5,542,669 A 8/1996 Charron et al.
5,577,731 A 11/1996 Jones
5,584,485 A 12/1996 Jones et al.
5,586,936 A 12/1996 Bennett et al.
5,607,162 A 3/1997 Boylan et al.
5,626,341 A 5/1997 Jones et al.
5,660,391 A 8/1997 Klasee
5,660,393 A 8/1997 Dreger
5,664,781 A 9/1997 Feola
5,707,285 A 1/1998 Place et al.
5,775,692 A * 7/1998 Watts et al. ..... 273/143 R
5,794,964 A 8/1998 Jones et al.
5,795,225 A 8/1998 Jones et al.
5,823,874 A * 10/1998 Adams ..... 463/17
5,848,932 A * 12/1998 Adams ..... 463/20
5,851,148 A * 12/1998 Brune et al. ..... 463/25
5,863,041 A 1/1999 Boylan et al.
5,882,261 A * 3/1999 Adams ..... 463/20
5,890,962 A 4/1999 Takemoto
5,911,418 A 6/1999 Adams
5,919,088 A * 7/1999 Weiss ..... 463/9
5,934,998 A 8/1999 Forte et al.
5,947,820 A * 9/1999 Morro et al. ..... 463/9
6,004,207 A 12/1999 Wilson, Jr. et al.
6,012,982 A * 1/2000 Piechowiak et al. ..... 463/16
6,015,346 A * 1/2000 Bennett ..... 463/20
6,089,978 A * 7/2000 Adams ..... 463/20
6,117,009 A * 9/2000 Yoseloff ..... 463/20
6,146,270 A 11/2000 Huard et al.
6,165,069 A 12/2000 Sines et al.
6,179,711 B1 1/2001 Yoseloff
6,227,969 B1 5/2001 Yoseloff
6,267,671 B1 7/2001 Hogan
6,311,976 B1 * 11/2001 Yoseloff et al. ..... 273/138.2
6,312,334 B1 * 11/2001 Yoseloff ..... 463/25
6,471,208 B2 * 10/2002 Yoseloff et al. ..... 273/143 R

* cited by examiner

METHOD OF PLAYING A TABLE CARD GAME WITH AN ELECTRONIC MULTIPLIER BONUS FEATURE AND APPARATUS FOR PLAYING THE GAME

RELATED APPLICATIONS

This application is a continuation-in-part application of U.S. patent application Ser. No. 09/394,748 filed Sep. 13, 1999 entitled: METHOD OF PLAYING A GAME, APPARATUS FOR PLAYING A GAME AND GAME WITH MULTIPLIER BONUS FEATURE, now U.S. Pat. No. 6,471,208.

BACKGROUND OF THE INVENTION

1. Field of the Invention

The present invention is directed to novel gaming devices, novel gaming processes and novel games and game apparatus associated with card table games. In some casino games, predetermined events at the table (such as achieving a blackjack) trigger bonus segments. A microprocessor driven system is used to support the bonus feature.

2. Background of the Art

Games of chance have been enjoyed by people for thousands of years and have enjoyed increased and widespread popularity in recent times. As with most forms of entertainment, players enjoy playing a wide variety of casino games and enjoy learning to play new games. Playing new games adds to the excitement of "gaming." As is well known in the art and as used herein, the term "gaming" and "gaming devices" are used to indicate that some form of wagering is involved, and that players must make wagers of value, whether actual currency or some equivalent of value, e.g., token or credit. Table games are those gaming systems where players at a physical table engage in the play of a wagering game, usually with a dealer (directly involved in the play of a wagering game) or a house representative (not involved in actual play, but directing the play of a wagering game). Cards, either a standard playing card deck, multiple standard decks, modified decks, or specialty decks are generally used in the play of casino table games such as casino table card games.

A particularly popular casino table game is twenty-one. As outlined in U.S. Pat. No. 5,154,492 (LeVasseur), conventional twenty-one is played in most casinos and involves a game of chance between a dealer and one or more players using a standard deck or multiple decks of playing cards. The object is for the player to achieve a count of his hand closer to 21 than the count of the hand of the dealer. If the count of the player's hand goes over 21 then the player loses regardless of the final count of the dealer's hand.

At least one standard deck of playing cards is used to play the game. The game is most commonly dealt as a multiple deck game. Each card counts as its face value, except aces, which have a value of one or eleven as is most beneficial to the count of the hand. Each player initially receives two cards. The dealer also receives two cards. One of the dealer's cards usually is dealt face down and the other of the dealer's cards is dealt face up.

A player may draw additional cards (take "hits") in order to try and beat the ultimate count of the dealer's hand or to remain in play when a dealer exceeds a count of twenty-one (known as "busting" or "breaking"). If the player's count exceeds 21, the player "busts." Similarly, if the dealer's count exceeds 21, the dealer busts. The player may "stand" on any count of 21 or less. When a player busts, he loses his wager regardless of whether or not the dealer busts. After all of the players have taken hits or stood on their hand, the dealer "stands" or "hits" based on pre-established rules for the game. Typically, if the dealer has less than 17, the dealer must take a hit. If the dealer has 17 or more, the dealer stands.

After the dealer's final hand has been established, the numerical count of the dealer's hand is compared to the numerical count of the player's hand. If the dealer busts, the player wins regardless of the numerical count of his hand. If neither the player nor the dealer have busted, the closest hand to numerical count of 21, without going over, wins; tie hands are a "push."

As used in the preceding description and in this disclosure, the terms "conventional twenty-one" and "the conventional manner of play of twenty-one" mean the game of twenty-one as described herein and also including any of the known variations of the game of twenty-one. There are many such variations, such as removal of specific value cards, addition of wild cards, bonuses for consecutive blackjacks, bonuses for suited blackjacks, automatic wins with at least six cards in a players hand, wins for 'five-card straights' in a player's cards, and the like.

Twenty-one has remained remarkably popular and unchanged over the years. Because of its popularity, the rapidity of play, and the need to reduce or eliminate card counting by players, twenty-one is usually played with multiple decks of cards that are frequently shuffled.

Other casino table card games include Let It Ride® stud poker (as described in U.S. Pat. No. 5,288,081, a playing card wagering game method which involves each player placing a three part bet. Cards are dealt by the dealer, two face down to the dealer and three face down to each player. Players inspect or "sweat" their cards and the dealer gives each player the choice of withdrawing or leaving at risk a first part of the bet. Each player decides and the dealer then turns over one of the cards and again gives each player the choice of withdrawing or leaving the second part of the bet. The players decide, their cards are shown, and all remaining bets, which were not withdrawn, are resolved.); Caribbean Stud® poker (as described in U.S. Pat. No. 4,86,553, a card game in which a player and a dealer are each dealt five cards. If the dealer has a poker hand having a value less than Ace-King combination or better, the player automatically wins. If the dealer has a poker hand having a value of an Ace-King combination or better, then the higher of the player's or the dealer's hand wins. If the player wins, he receives a bonus payment depending on the poker rank of his hand.); and Pai Gow poker (as described in U.S. Pat. No. 5,275,411 in association with a unique card shuffling and dealing system). Although both Let It Ride® stud poker and Caribbean Stud® poker have the potential for the award of bonuses, these bonuses are directly dependent upon the occurrence of hands of very high rank to a player.

One popular game of chance is the slot machine. Conventionally, a slot machine is configured for a player to wager something of value, e.g., currency, house token, established credit or other representation of currency or credit. After the wager has been made, the player activates the slot machine to cause a random event to occur. The player wagers that particular random events will occur that will return value to the player. A standard device causes a plurality of reels to spin and ultimately stop, displaying a random combination of some form of indicia, for example, numbers or symbols. If this display contains one of a preselected plurality of winning combinations, the machine releases money into a payout chute or increments a credit meter by the amount won by the player. For example, if a player initially wagered two coins of a specific denomination and that player achieved a payout, that player may receive the same number or multiples of the wager amount in coins of the same denomination as wagered.

There are many different formats for generating the random display of events that can occur to determine payouts in wagering devices. The standard or original format was the use of three reels with symbols distributed over the face of the wheel. When the three reels were spun, they would eventually each stop in turn, displaying a combination of three three symbols (e.g., with three wheels and the use of a single payout line as a row in the middle of the area where the symbols are displayed. By appropriately distributing and varying the symbols on each of the reels, the random occurrence of predetermined winning combinations can be provided in mathematically predetermined probabilities. By clearly providing for specific probabilities for each of the preselected winning outcomes, precise odds that would control the amount of the payout for any particular combination and the percentage return on wagers for the house could be readily controlled.

Other formats of gaming apparatus that have developed in a progression from the pure slot machine with three reels have dramatically increased with the development of video gaming apparatus. Rather than have only mechanical elements such as wheels or reels that turn and stop to randomly display symbols, video gaming apparatus and the rapidly increasing sophistication in hardware and software have enabled an explosion of new and exciting gaming apparatus. The earlier video apparatus merely imitated or simulated the mechanical slot games in the belief that players would want to play only the same games. Early video games therefore were simulated slot machines. The use of video gaming apparatus to play new games such as draw poker and Keno broke the ground for the realization that there were many untapped formats for gaming apparatus.

Now casinos may have hundreds of different types of gaming apparatus with an equal number of significant differences in play. The apparatus may vary from traditional three reel slot machines with a single payout line, reel slot machines with bonus features (such as Wheel of Fortune®) video simulations of three reel video slot machines, to five reel, five column simulated slot machines with a choice of twenty or more distinct paylines, including randomly placed lines, scatter pays, or single image payouts.

In addition to the variation in formats for the play of games, bonus plays, bonus awards, and progressive jackpots have been introduced with great success. The bonuses may be associated with the play of games that are quite distinct from the play of the original game, such as the video display of a horse race with "bets" on the individual horses randomly assigned to players that qualify for a bonus, the spinning of a random wheel with fixed amounts of a bonus payout on the wheel (or simulation thereof), or attempting to select a random card that is of higher value than a card exposed on behalf of a virtual dealer.

Examples of such gaming apparatus with a distinct bonus feature includes U.S. Pat. Nos. 5,823,874; 5,848,932; 5,836,041; U.K. Patent Nos. 2 201 821 A; 2 202 984 A; and 2 072 395A; and German Patent DE 40 14 477 A1. Each of these patents differ in fairly subtle ways as to the manner in which the bonus round is played. British patent 2 201 821 A and DE 37 00 861 A1 describe a gaming apparatus in which after a winning outcome is first achieved in a reel-type gaming segment, a second segment is engaged to determine the amount of money or extra games awarded. The second segment gaming play involves a spinning wheel with awards listed thereon (e.g., the number of coins or number of extra plays) and a spinning arrow that will point to segments of the wheel with the values of the awards thereon. A player will press a stop button and the arrow will point to one of the values. The specification indicates both that there is a level of skill possibly involved in the stopping of the wheel and the arrow(s), and also that an associated computer operates the random selection of the rotatable numbers and determines the results in the additional winning game, which indicates some level of random selection in the second gaming segment.

U.K. Patent No. 2 202 984 A describes a slot machine in which when a player has not won a prize in the basic game (that in itself is a randomly determined event), there is the possibility of winning a prize in a complementary game of chance, such as a lottery where numbered balls are removed from a rotating drum device.

U.K. Patent No. 2 072 395 A describes a gaming or amusement machine having a spinning reel device and a video screen on which a video game may be displayed. A play on the video game may be an award for winning events on the reels.

U.S. Pat. Nos. 5,823,874 and 5,848,932 describe a gaming device comprising: a first, standard gaming unit for displaying a randomly selected combination of indicia, said displayed indicia selected from the group consisting of reels, indicia of reels, indicia of playing cards, and combinations thereof; means for generating at least one signal corresponding to at least one select display of indicia by said first, standard gaming unit; means for providing at least one discernible indicia of a mechanical bonus indicator, said discernible indicia indicating at least one of a plurality of possible bonuses, wherein said providing means is operatively connected to said first, standard gaming unit and becomes actuatable in response to said signal. In effect, the second gaming event simulates a mechanical bonus indicator such as a roulette wheel or wheel with a pointing element.

U.S. Pat. No. 6,227,696 makes an advance in combined gaming technology by providing a video display in conjunction with a physical casino table card game as a separate game. A side game with potential wagering is provided along with an underlying game. The side game may include the use of symbols or cards or card figures, and may be played live, on video gaming apparatus, or with a combination of live play and various display means, including, but not limited to, cathode ray tubes (monitors), light-emitting diodes (LED's), Liquid Crystal Displays (LCD's), plasma displays and other video gaming displays. A method of playing both an underlying game and a side bet game has the steps of: a) playing an underlying game in which at least two cards are received and at least two cards are kept by a player at the end of an underlying game and at least one wager is placed by the player on the underlying game, b) a player placing a wager on a side bet game, c) providing to the view of the player at least two randomly generated cards which become a part of the side bet game, d) comparing the at least two cards kept at the end of the underlying game to the at least two randomly generated cards which become part of the side bet game, and e) determining a level of correspondence between the at least two cards kept at the end of the underlying game and the at least two randomly generated cards which become part of the side bet game. Wagers may be placed at any time before, during or after play of the underlying game.

To increase the excitement and entertainment of the player and to offer new games to the player, side bet games have been developed, both for live gaming and for video gaming. In some situations, awards for the side bet games may be independent of the rank of the dealt hand in the primary game. A common feature in some poker games is the addition of a progressive jackpot, as described in U.S. Pat. Nos. 4,861,041; 5,377,973; 5,584,485; and 5,626,341 and specifically to games of Twenty-One in U.S. Pat. Nos. 5,288,077; 5,364,105; and 5,577,731. These patents generally show that a progressive, and possibly much higher value jackpot, may be won by a player by making a separate and independent wager at the beginning of the primary game (before cards are dealt). This separate wager is won if predetermined arrangements of cards, such as certain poker hands of rated value (usually at least three-of-a-kind, straight, flush, full house, four-of-a-kind, straight flush and royal flush), are achieved in the play of the hand. The highest progressive jackpot value is usually won when the player obtains a royal flush, either with the cards in a specific order (e.g., A K Q J 10, also referred to as a "positional win") or in a random order (e.g., with the cards A K Q J 10 appearing in any arrangement or order). With the separate bet being placed, the jackpot or special award for the player achieving a rated (higher value) hand is paid in addition to awards won in the play of the primary game. This separate wager, however, is still won only when the player exhibits a hand with a relatively high poker value. A predetermined arrangement of cards which is independent of play in the underlying game could be, for example, a rank of a poker hand achieved in the play of a hand of Twenty-One, four aces in a Twenty-One game, or a Twenty-One point count total achieved in a poker hand. An example of a predetermined arrangement of cards which is dependent upon play of the underlying game could be, for example, specific ranks of poker hands (e.g., four-of-a-kind or straight flush) achieved during play of an underlying poker game.

U.S. Pat. No. 5,934,998 describes a complex system of blackjack play using an adjunct computing system for playing a card game involving a dealer and at least one player. The method includes the step of establishing a predetermined player jackpot tally event wherein said predetermined player jackpot tally event is a predetermined outcome of a player's card hand. The method includes establishing a predetermined dealer bust event wherein said predetermined dealer bust event is a predetermined outcome of a dealer's card hand; providing a player jackpot tally event status display for each player comprising a numeric LED readout visible to all players and the dealer and providing a dealer bust event status display. The display includes a numeric LED readout visible to all players and the dealer. The method further includes starting a round of play by dealing a card hand to each player and to the dealer; determining whether a player jackpot tally event has occurred for each player and determining whether a dealer bust event has occurred for the dealer. The player's player jackpot tally event is incremented if said player's card hand is a predetermined player jackpot tally event. The method includes the step of incrementing said dealer bust event display if said dealer's card hand is a predetermined dealer bust event; continuing another round of play and incrementing each player jackpot tally event display and dealer bust event display as recited above. While continuous rounds are played, players are rewarded when their player jackpot tally event display has exceeded a predetermined player jackpot tally event threshold. All players are rewarded if said dealer bust event display has exceeded a predetermined dealer bust event threshold. The player jackpot tally event display is zeroed when the associated player's card hand does not increment the player's said jackpot tally event display. The method also includes zeroing said dealer jackpot tally event display when the dealer's card hand did not increment said dealer bust event display.

U.S. Pat. No. 6,146,270 describes an apparatus for playing a game consisting of an auxiliary prize game played along with a principal casino game played by a dealer and a plurality of players seated at a plurality of player positions at a casino gaming table. The players possess a number of gaming symbols as a result of playing said principal casino game. The apparatus includes an input device generating a game state signal in response to a dealer command input and a random selector generating at random a value representing a set of said player positions. The set of player positions consists of at least one of none, some and all of said player positions; and a selection indicator indicating based on said value and in response to said state signal ones of said player positions having been selected. Players enjoy an extra random component in the determination of winnings in the auxiliary prize game.

There are currently a number of commercially available blackjack games with side bet opportunities. One such game is called Wheel of Madness™. The player makes a mandatory bet on the blackjack game, and optionally places a bonus bet on the occurrence of a blackjack. If the player obtains a blackjack, the dealer spins a wheel. The amount displayed on the wheel determines the payout.

In a game recently introduced by Mikohn Gaming in Las Vegas, Nev., a live casino blackjack game is equipped with a Monopoly® side bet apparatus and feature. The side bet feature is a video display bearing a visual representation of a Monopoly® game board. If the player has made the optional side bet and receives a blackjack, a video representation of a train moves around the outside of the board, slowly reducing its speed until the front of the train stops at one of the board locations, designating the selected location. Each location bears a payout multiplier. The amount wagered on the side bet game times the multiplier defines the bonus payout.

Since it is desirable to offer players games that they have not played before, it would be desirable to provide new games with new additional opportunities to receive winning payouts.

SUMMARY OF THE INVENTION

The present invention is a live casino game equipped with a separate gaming apparatus capable of determining outcomes of an auxiliary side bet game. In one example of the invention, the live casino game is blackjack, and the separate gaming apparatus comprises a video gaming apparatus with a microprocessor, a random number generator, and a video display.

In the broadest form of the invention, the casino table card game includes an auxiliary, bonus-effecting gaming process and gaming apparatus. The first base casino table card game provides a first gaming segment in which after a player provides at least an initial wager, a predetermined event or events provide an outcome or series of outcomes that are considered to determine if a defining event occurs, such as a predetermined arrangement of cards, predetermined order of cards, predetermined number of consecutive wins or losses, or predetermined combinations of cards in a single hand (e.g., blackjack, same suited blackjack, split aces double blackjack, split tens double blackjack or blackjack and twenty's, for example) occurs. Upon the occurrence of a defining event, a player carries a predetermined amount from the event that he can carry into a bonus event. The predetermined amount may be the original wager in the base game, the win amount, a portion of the win amount (e.g., the 50% bonus for a blackjack), or a separate wager on the occurrence of the defining event (e.g., a side bet or bonus bet). This predetermined amount is designed so that the player can carry the predetermined amount into a bonus event. Typically, the predetermined amount is a separate bonus bet. The bonus event comprises at least one gaming segment, at least two gaming segments, or a series of at least two related gaming play segments that are substantively different from the base game. The bonus event is a random event controlled and played on a microprocessor (e.g., computer, hardware, software, an independent random number generator, and the like), while the first gaming segment is played with physical cards at a casino table. At least one of the second gaming segments comprises a display of multiple panels, such as frames within one or more video displays (e.g., monitors, screens, panels, etc.) that display symbols, such as multiplication factors. The symbols or factors within each frame change over time, either randomly or in sequence. If the bonus segment of the game is a multiple bonus segment game, different symbols or factors appear within at least some of the frames or certain symbols appear at a different frequency during subsequent bonus segments. At least one highlighting feature, such as increased or decreased light intensity of the frames optionally occurs during the time when the symbols or factors are changing. The random selection may also occur without any highlighting so that their selection has no visual imagery except for the conclusion. A player may activate a stop button to halt both the changing of symbols or factors within a frame and stop the highlighting feature so that at least one frame is highlighted. The highlighted frame presents a multiplication factor or other bonus symbol that is applied to the wager or the amount awarded from the occurrence of the predetermined event in the first play segment. The result of the multiplication of the predetermined amount (e.g., the initial wager, the side bet amount, a bonus win amount or the amount awarded) may then preferably be carried forward into at least one more (and even additional) gaming segment (s) that includes a multiplier.

The first segment of the gaming device of the present invention is a casino table game. The game may be any casino table card game, not only blackjack and the variants of poker specifically or generally references above, but also Casino War™, match card games, Three Card Poker™, bacarrat, and the like. The first segment preferably awards payouts for specific events or wins that occur in the play of the game. Preferably, the occurrence of a minimum number of a single predefined event(s) occurring in the play of the game triggers the bonus event. The predetermined event(s) may or may not be wins in the actual game. The use of scanning technology (electronic recognition of bets, card rank and suit, player identity, and the like) on the table to keep track of events is also very useful in identifying specific events or series of events that are intended to result in triggering a bonus event.

DETAILED DESCRIPTION OF THE INVENTION

Figure 1:
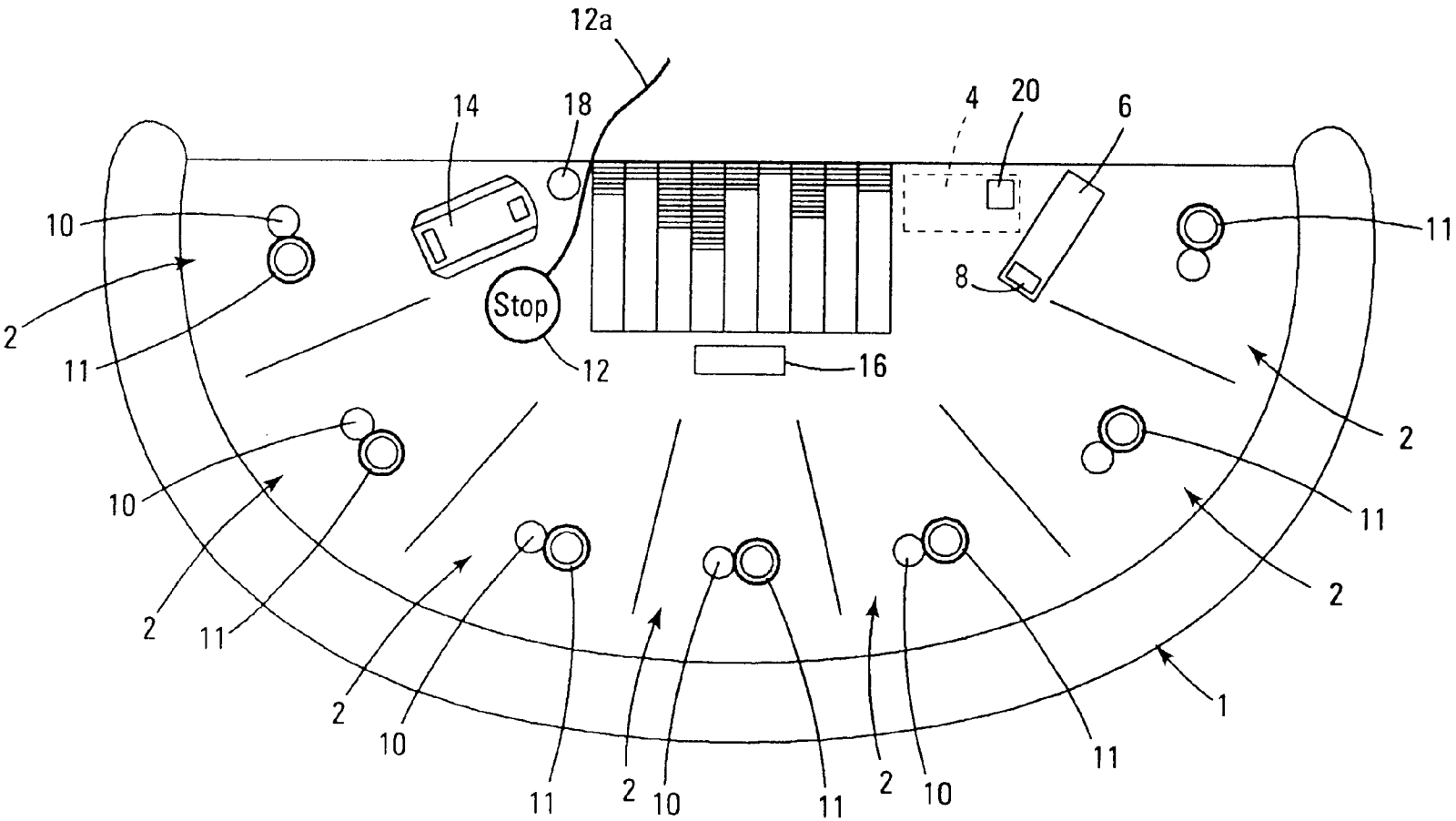
FIG. 1 shows a display panel with a first format for providing an indication of bonus indicia.

The various embodiments of the present invention are designed to provide added excitement to a casino table game and to increase the enjoyment to players. The underlying concept in the practice of the invention comprises a game, gaming process and gaming apparatus to implement the game. The game comprises a player entering a first casino table card gaming segment. Players usually enter first gaming segments by placing a wager on a randomly occurring event, such as the attainment of a single unique player's hand or a sequence of events in a card game (e.g., either 3, 4, 5, 6, or 7 card stud, draw poker, wild card poker, pai gow poker, blackjack or variants thereon). The normal wager may be placed on the table. If a side bet is used in entering the play of the chance to engage in a bonus event, this may be done by separate positioning of a wager on the table, the dealer collecting the side bet or the table apparatus sensing the side bet wager and automatically collecting the side bet wager (e.g., with a drop box collecting inserted coins or tokens, accessing credit directly, inserting currency or credit cards to establish a line of credit, physically placing the bet on the table and having the dealer sweep the bets after the bet is electronically registered or physically marked, or diminishing existing credit evidenced in the apparatus, as on a credit display).

The first segment game is preferably blackjack, and preferably blackjack played with physical cards, although a video simulation table game of blackjack may also be used.

The base game may be a house banked game, or a player banked game. Player banked games allow the player banking the game to collect all player losses, but also require the player to award payouts. The house takes a rake that is usually a flat fee or a percentage of wagers placed. In a player banked game, players take turns banking each round of play. Players who do not wish to bank the round may pass. Players who choose to bank a game can represent themselves, or represent an organization that banks such games. The house provides a dealer to administer the game. California card rooms currently operate player banked versions of many casino table games, including blackjack, Let it Ride® Stud Poker and Three Card Poker®, to name a few examples.

In the play of the bonus game, players may be awarded specific numbers of bonus plays or rounds depending upon the particular predetermined events that occur. These bonus numbers of plays may be awarded by providing player(s) symbols on the video display that is associated with the bonus event and/or by special signaling (one or more lights or screen displayed symbols) at specific player positions. One preferred specialty symbol includes a "whammy," in the form of an animated devil that serves as a symbol for the bonus feature. In one form of the game, the "whammy" designates a loss in the bonus round. Preferably, the number of bonus play events in the bonus segment of the game can be displayed for general viewing by the players. Assignee's copending application describes a method of providing second screen multiplier features in a video wagering game. The subject matter of that copending application, "Method of Scoring a Video Wagering Game," Ser. No. 08/820,438, filed Mar. 12, 1997 is herein incorporated by reference.

As previously noted, each game may be designed for one or more specific events to trigger bonus play. This event(s) triggers the bonus round of play. The player is then awarded a predetermined number (e.g., one, two or three) of opportunities to participate in the bonus segment. Although in the example provided above the triggering event is a winning event (for example, obtaining a blackjack), it is not necessary to award the player a payout in the first segment to qualify the player to participate in the second segment of the game. For example, in a blackjack base game, the triggering event might be a blackjack, a suited blackjack, consecutive blackjacks, consecutive 21's, specific numbers of consecutive losses (e.g., 3, 4, 5, 6 or 7 consecutive losses), or any other specific event that is defined in drafting rules for the play of the base game to trigger bonus play. When the base game is poker, examples of the specific triggering event include five-card straight in a player's hand, full houses or better (these events could also be used in a blackjack game).

The advantage of card and/or bet sensing in the play of the base game can be appreciated as a facilitating apparatus in the play of the bonus aspects of the game. By programming a microprocessor as to the bonus triggering events, these events may be automatically identified by an apparatus, rather then by requiring the dealer or the player to accurately account for events (e.g., three consecutive blackjacks or six consecutive losses coupled with a corresponding bet). The microprocessor associated with the reading of cards to individual hands [e.g., done by scanning cards as they leave a shoe, scanning cards as the shuffling apparatus deals hands, scanning cards within the shuffling or hand creating apparatus (as described in copending U.S. patent application Ser. No. 09/957,665, filed Sep. 20, 2001, bearing attorney's docket number PA0600.ap.US and titled, Card Shuffler With Sequential Card Feeding Module And Method Of Delivering Groups Of Cards), or scanning cards on the table surface may also be used to signal the occurrence of the predetermined triggering event, control the play of the bonus event, determine the amount involved in the bonus play (e.g., by weighing chips, optically scanning chips to determine how many chips have been wagered, calculating extra award amounts entered into bonus play, or the like, as known in the art and as improved upon), calculate awards, signal displays to publicize bonus events, control sound and visual displays, and the like. After providing a conclusion to an event in the play of the first gaming segment, the play of that hand or consecutive hands are examined to determine if a defining event has occurred. A defining event, defined event, or predefined event means in the practice of the present invention that a predetermined random event has occurred that is recognized as a predetermined defined event, as described above. At least some portion (including all) of either or both the initial wager, a side wager and/or any amount awarded to the player for the occurrence of the defining event may then be carried forth into the play of the bonus segment, the second segment (and optionally subsequent segments) of the game. In one preferred embodiment, the defining event is the occurrence of, for example, a blackjack. The entrance into the second segment is compulsory when the rules of the game so dictate and is not optional, and the play of the second segment requires the play of at least one distinct round of play, and preferably at least two distinct rounds of bonus play. When the second segment of the game includes multiple bonus rounds, it is desirable that two or all of the distinct rounds of play require that the amount of wager in the bonus play is multiplied (factored) by an award factor or multiplier determined in the play of the bonus play element of the second gaming segment.

It is preferred that a side bet be made to effect or allow entry into play prior to or at the same time of making a bet in the base game to allow bonus events to be awarded, and for the size of the side bet to be used as the monetary basis for award of multiples in the bonus play. For example, a one-dollar side bet may be placed, and when the bonus event occurs, the sum of the multiples (times the initial side bet) in separate bonus rounds will be awarded, or even the factor of the multiples (times the initial side bet) will be awarded. Again, if the initial side bet wager were 1 or five dollars, with two bonus spins, the award for a first factor of 5 and a second factor of 50 would be 55 dollars for a one-dollar side bet and 257 dollars for a five dollar side bet wager (when the factors are additive) and 250 dollars and 1250 dollars if the factors are to be factored (5×50) against the initial side bet wager.

The at least one distinct round of bonus play comprises the use of a panel or display of multiple possible factors. The generic term used in the practice of the present invention for any mechanism capable of displaying the group of factors that may be selected in play of this at least distinct round of play in the bonus feature is a factor display. A factor display is any display device (mechanical, electromechanical, electronic, video, flat panel, plasma, liquid crystal display, etc.) that can show multiple panels or multiple display areas, at least some if not all of the panels being capable of displaying alternating (though not necessarily in a specific pattern, although that is an option) factors. By alternating factors it is meant that the same value is not displayed continuously within at least some frames. For example, the factor in a given panel may randomly alternate between factors such as 1, 2, 3, 4, 5, 6, 7, 8, 9, 10, 15, 20, 25, 50, 75, 100 and the like during the course of the bonus round.

Individual factors may reappear in the group from which the factors are selected, and the selection from the group of numbers (which may be as small as two numbers in the group, preferably three or more numbers in the group) may be random from within the group or in an unvarying sequence. For example, a particular frame might display, c, 10, 2, 4, 2, 8, 15 and then 2 in a particular bouns round. At the same time that factors within at least some of the frames are alternating, a highlighting function is preferably also being enacted. A highlighting function is any visual event that focuses visual attention onto specific frames (less than all frames, preferably one or more frames). In a least preferred embodiment, a pointer such as a virtual arrow or line points to the highlighted frame.

More preferably the individual frame undergoes a change in lighting intensity or color or framing color as the highlighting feature. For example, the frame may increase the intensity of illumination within the frame, decrease the intensity of illumination within the frame, change colors within the frame, change background patterns within the frame, change the edging color, edging intensity, edging pattern or edging shape of the frame, change the size of the frame, or any other visually observable change that will indicate to the player that a selection process is operating. The player may then actuate the computer to randomly select a position for stopping the highlighting and thus highlighting a specific factor in that frame. Although the stop actuation gives the impression of control over the selection, by law the selection must be based on random selection rather than true skill. The factor will then be applied to one of 1) the amount wagered on the base game in the first game segment, 2) the amount wagered on the bonus segment, 3) the amount won in the first game segment, or 4) another predetermined amount, to determine the amount that the player is then entitled to carry hold and/or carry forth into a compulsory second bonus play feature of one or more additional gaming segments.

The second bonus play feature may be the same, relatively the same or different from the first bonus play feature in the second gaming segment. For example, either the initial wager on the base game, the initial wager on the bonus game, the initial amount won in the play of the first gaming segment, the initial wager plus the amount won in the play of the first gaming segment, the amount won by play in the first bonus play of the second gaming segment or the initial wager and the amount won in the play of the first bonus play in the second gaming segment, or combinations thereof, are wagered in the play of the second bonus play in the second gaming segment. Upon determination of a factor in the play of the second bonus play in the second gaming segment, that second determined factor is preferably applied against the amount won in the first bonus round of the second segment of play. The result of that application of the factor in the second bonus play of the second gaming segment will either determine the absolute amount that the player is then entitled to or is added to any carried over amount that the player was already entitled to.

This mathematic treatment can alternatively be exemplified by consideration of specific additive award treatments. Assuming a 5 unit initial side bet wager, the player may win, for example, a total of 5 or 10 units (the five wagered and five added for a winning event, if that is a triggering event) in the play of the first base game segment and attains a first defined event that compels the player into a bonus play second gaming segment. Among the options in the design of the game are carrying forth the initial wager (5 units) and retaining the amount added to the returned initial wager (10 units), carrying forth only the amount won (5 units), carrying forth the side bet wager, and/or carrying forth the amount won less the amount wagered. By way of example only, the amount wagered in the second gaming segment (here for example selected as only the initial wager, so that 5 units are wagered and 5 units are retained by the player) is the amount initially wagered in the play of the first gaming segment. Upon play of the first bonus feature or bonus play in the second gaming segment, a factor of 8 is obtained. The player thus has 10 units retained (the amount won in the first gaming segment, but not wagered in the second gaming segment) and 40 units (8×5=40) in play in the second gaming segment. The player then advances to a second bonus play in the second gaming segment. Again, there may or may not be an option on what amount may be wagered on this second segment, the choices now being all or part of the amount won in the first gaming segment less the amount wagered (10 units), the amount still controlled from play of the first bonus play of the second gaming segment (40 units) or the total of all (45 units) or part of a combination of the two groups of units.

For example only here, it will be assumed that the player may wager only the remainder or total of the amount resulting from the wager and play of the first bonus play in the second gaming segment (4 units). A randomly selected multiplier is then preferably determined in the second bonus play of the second gaming segment (although selection of a sum certain payout amount to be added or subtracted from the wager may also be used). After the second multiplier is determined, that multiplier is factored against the amount wagered in the play of the second bonus feature in the second gaming segment. If a factor of 15 is randomly selected (as by the same or substantially same or different mechanism used in the play of the first bonus play of the second gaming segment), that factor is applied against the amount wagered, in this example, 40 units, and a continuing bonus amount of (15×40=600) is now controlled by the player. The player, under this example now has 10 retained units plus 600 units in his control. Where there are only two bonus plays in the second gaming segment, the player will then have 610 units added to the credit amount registered on the machine or have 610 units paid out.

In one preferred format of play, the player earns a number of bonus rounds corresponding to the number of bonus rounds predetermined in the rules of the game to be provided for specific events. For example, if the player has placed a $1 side bet wager on every hand, he may be awarded one bonus spin for a single blackjack and two bonus spins for two consecutive blackjacks (and it may be a game play rule that after a first blackjack, the side bet wager must remain constant in the next hand played). There is therefore the potential for multiple bonus opportunities, such as a third bonus play, in the second gaming segment. There are numerous options available in the design of the game for the amount of the wager in the third bonus play and subsequent rounds in the second gaming segment, however, the play and factoring of that amount are generally within the description provided above for play of the second bonus play of the second gaming segment. At the conclusion of a third and last bonus play in the second gaming segment, the total amount returned to the player will be returned as credits or paid out as units (coins or tokens). In the practice of the present invention, a trigger event is a particular event that is predetermined or preselected to initiate a bonus event by its mere occurrence, whether or not that event is a winning combination in the play of the base game.

That method may include events during play of the at least one bonus play in the second gaming segment, wherein at least one of said number of factor areas is highlighted, as described in greater detail herein. The method may be practiced wherein the highlighting is stopped and the change of factor displays is stopped, with a highlighting feature identifying at least one factor. For example, as also described elsewhere herein, a panel display of frames or display areas in a grid may have individual values of factors or multipliers change with time, while the highlighting feature moves from grid to grid.

One method of play according to the present invention would be described as:

a) a player making a wager and playing a first wagering card game;

b) upon achieving a predetermined triggering event in the play of the first wagering card game, the player is awarded at least one bonus play;

c) the bonus play comprises a random selection of an additive bonus for an award to a player or a random selection of a factor bonus to be applied to a base amount; and d) the additive bonus or the factor bonus applied to a base amount being awarded to the player in addition to any awards from play of the first wagering game or together with any award from play of the first wagering game.

It is preferred that in addition to a wager being made in accordance with step a), a side wager is placed to enter the player into a side game to allow possibility of achieving bonus play. That is, if the player makes a side wager that he/she will achieve the qualifying event, and that qualifying or triggering event occurs, the player is awarded the bonus. On the other hand, if the player does not make a side wager that he/she will achieve the qualifying event, and that qualifying or triggering event occurs, the player is not awarded the chance to participate in bonus play. The base amount identified above is preferably the side bet wagered amount, and the preferred bonus is a factor (a multiplier) of the base amount. In one example of the invention, certain triggering events may provide for multiple bonus rounds as described above.

For example, the player may place a $5.00 bet in a basic blackjack game, and $1.00 on a side bet game. Assuming the triggering event is achieving a blackjack, and the player does so, he is paid 3:2 on this basic bet as is customary in traditional blackjack, and enters the bonus round. In this example of the invention, he is awarded two bonus events. In the first bonus event, the player is awarded a factor of 5. He is awarded a total of 5 credits (5×$1.00 bet in the side bet) in the first round. He is then awarded a factor of 20. His second bonus award is $20.00 (a factor of 20 times $1.00). This is an additive award, so his total bonus award is $25.00 ($5.00 plus $20.00). This payout is in addition to the payout on the base game.

It will facilitate an understanding of the method of play to describe an example of the steps in playing such a game, with the example showing blackjack as the first wagering card game, although it will be apparent to those skilled in the art how other card wagering games may be used in parallel practice of the invention.

Players have assigned seats at a gaming table 1 shown in FIG. 1. Seven player positions 2 are shown on the table 1. A microprocessor 4 is positioned under the table 1. In one example of the invention, the microprocessor communicates with a card shuffling device 6 such as a Shuffle Master Gaming, Inc. Ace® shuffler or Shuffle Master Gaming, Inc. King® shuffler. Cards 8 are provided to each player position 2 and to the dealer's hand position 16, the cards being provided in the customary manner, typically one at a time to each of the player positions 2 and the dealer's hand position 16.

Prior to dealing the cards to players and dealer, at least a wager in the blackjack game is placed on the table 1, usually in wagering space 10. If the individual players want to be able to gain access to the bonus element of the game, a separate wager, referred to as the side bet wager, is placed into space 11. The space 11 preferably automatically detects the presence of the side bet, and provides an indication that a side bet wager has been placed at that player position 2. This indication may be in the form of a signal directly to the microprocessor (with the placement of the wager sensed by an optical sensor, weight sensor, proximity detector, manual pressure on the space 11, or the like) or the dealer may manually input data into the microprocessor. Alternatively, a light may be activated in or adjacent to space 11, so that there is a visual indication that the side bet wager has been placed at a specific player position 2.

Figure 2:
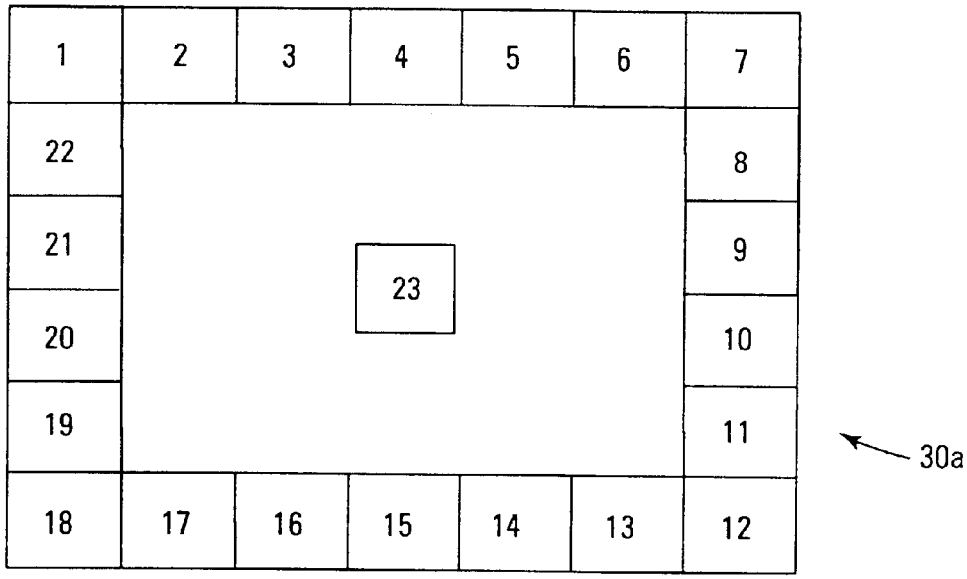
FIG. 2 shows a display panel with a second format for providing an indication of bonus indicia.
Figure 3:
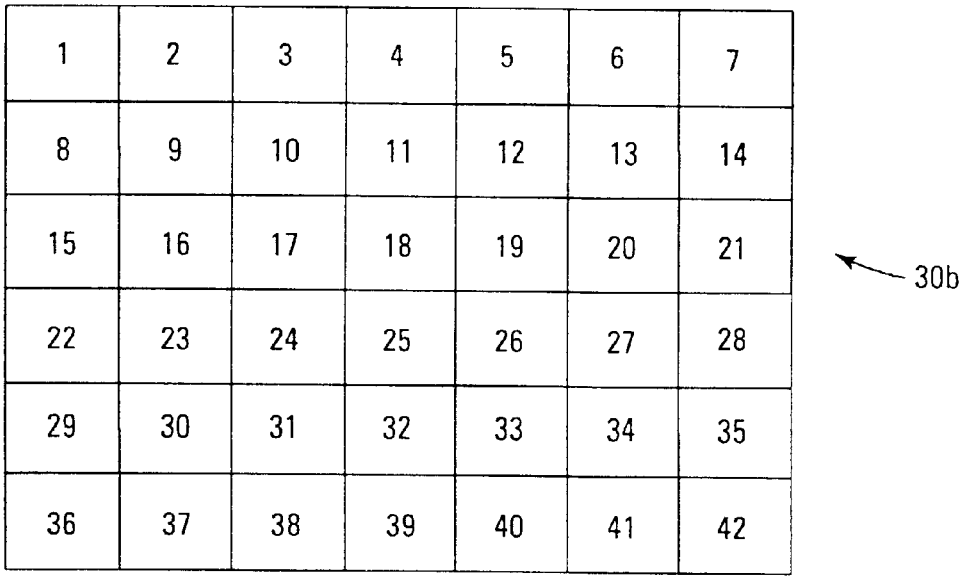
FIG. 3 shows a casino table with player positions and a bonus display screen associated with the casino table.

After the side bet wagers have been placed (or not placed), the traditional or variant of the game of blackjack or 21 is played. The cards at the end of the play of each hand where a side bet wager has been placed in the card game are examined (either my means of an optical scanning or another type of card reader such as a video reader, or by the dealer) to see if a triggering event or defining event or predetermined event occurs that allows a player to enter a bonus segment. If the dealer or the microprocessor 4 determines that a player has qualified for a bonus event, Press button 12 is activated, typically by the dealer, for each player individually when the player has qualified for the bonus event. A display panel (such as 30*a* or 30*b* as shown in FIG. 2 and FIG. 3) is activated as described above. It is to be noted that the numbers within the frames shown in FIGS. 2 and 3 correspond to frame numbers, not payouts or multipliers. According to the invention, symbols randomly appear within the frames once the device is activated. Typical game symbols include multipliers, whammies (designating a loss), plus spin, skip to the position right or left of the selected position, absolute payouts and multipliers plus spins. Other game symbols are contemplated. (It is also possible in this game for players to merely enter a number or position of a specific panel, with no moving lighting on the panels 30*a* and 30*b*) The panels are displayed, for example, on an embedded visual display device 14 on the table 1. In a preferred device, the visual display device 14 is an upright video monitor of a size and positioned such that all players and the dealer can visualize the bonus play and outcomes.

In a preferred form of the invention, the display device 14 is in communication with a programmable computer, and preferably falls within the definition of a gaming device by gaming regulators. The computer is equipped with a random number generator for guaranteeing that the selection of game symbols is fair and meets regulatory requirements. An example of one such system for controlling the operation of the display device 14 is described in commonly owned co-pending applications for Video Gaming Apparatus for Wagering With Universal Computerized Controller and I/O Interface for Unique Architecture, assigned Ser. No. 09/405, 921 and filed on Sep. 24, 199, and for Computerized Gaming System, Method and Apparatus, assigned Ser. No. 09/520, 405, and filed on Mar. 8, 2000, the disclosures of which are incorporated by reference.

In one example of the invention, the same button 12 is moveable on the table and is in communication with the microprocessor via a data line 12*a*. After activating the bonus feature, the dealer can then pass the moveable button 12 to the player participating in bonus play. The player may then contact the Press button 12 at his player position 2 to attempt to select an advantageous symbol or award. According to most jurisdictional requirements, there can be no potential for the exercise of skill in this selection, so that the pressing on the Press Button 12, even though it may stop light movement or even select a particular frame (e.g., 1–23 in FIG. 2 or 1–42 in FIG. 3) it will not determine the award or the bonus factor. The occurrence of the award or bonus factor is therefore randomly generated, as with a random number generator, by the microprocessor 4. That randomly assigned award or factor is then displayed on the monitor 14 and the final award for the bonus event is determined and may be displayed on the monitor 14. In one form of the invention, the number of bonus rounds is awarded prior to or during bonus play. Individual monitors (not shown) may be located at each player position to indicate the amount of the award or even to display factors or other game symbols.

As also noted above, the number of bonus plays is determined by the microprocessor and/or the rules of play of the game. After each bonus event is played, the award may be collectively totaled on the display screen 14 in view of the players. As also noted, the awards may be cumulative of factored, all of which information is displayed on the screen. The amounts of the award are determined according to the intended payout profile of the side bet game. For example, the awards may range from 0 times the side bet wager up to 100,000 times the side bet wager, with the probability of the awards being such that a margin is retained by the house. For example, if the frequency of the bonus triggering event occurring is calculated to be 1 event/50 game plays, the payouts from the bonus should be weighted to be less than 50 times the side bet wager, so that the weighted average payout would be, for example, 45 times the side bet wager. This can be done by having the random number generator weigh the events according to various algorithms such as those described in U.S. Pat. No. 4,448,419 and U.S. patent application Ser. No. 09/658,806, filed Sep. 11, 2000 and titled "METHOD AND APPARATUS FOR CONFIGURING A SLOT-TYPE WAGERING APPARATUS."

In one preferred form of the invention, the bonus display apparatus randomly displays in the display areas symbols from the following list of bonus game symbols: multipliers, fixed payout amounts, whammy's, bonus spin or spins, a fixed award plus a bonus spin, a multiplier plus a bonus spin, a move one or more frames in any direction, and a "big bucks" symbol. The big bucks symbol awards the player the highest possible payout possible in the round of play.

An additional method of play includes a method of playing a first casino table card wagering game comprising: a player wagering a first amount on a first casino table card wagering gaming segment that provides random events; when a predefined event or series of events occurs in the play of the first casino card wagering game for a player, the player engages in play of at least one bonus game in which no value of the player is at risk; the at least one bonus game comprising determination of a random award to be credited to the player engaging in the at least one bonus game; and awarding the random award to the player.

The random award may comprise a random absolute amount (e.g., 1, 2, 5, 10, 25, 50, 100, 500, 1,000, 10,000, 50,000 dollars or the like), may be a factor that is used to multiply a base amount, may be an award of extra bonus events, may be a fixed payout plus one or more bonus spins, may be a multiplier plus one or more bonus events, or may be a whammy. As noted above, the base amount may be the initial amount wagered by the player in the base game or a separately placed side bet, the amount won by the player, the sum of the amount wagered and the amount won by the player, or a side bet specific to entry by the player in an opportunity to engage in the bonus game. The factors may range from a whole number or fractional number (e.g., 1.5) factor of 1×, 1.5×, 2×, 5×, 10×, 25×, 50×, 100×, 250×, 500×, 1000×, 10,000×, 25,000×, 100,000× or the like.

The bonus game may provide a display for displaying absolute payout amounts, factors and/or other game symbols, comprising a number of factor areas (e.g., frame) within which factors or other game symbols are displayed, the number of factors displayed being greater than or equal to 1, especially where at least some of the factor areas change the factor displayed within that factor area during play of at least one bonus game. A microprocessor randomly selects a factor that is displayed, and the randomly selected factor is applied to the base amount to indicate a final bonus award. In this method, during play of the at least one bonus game, at least one of said number of factor areas may be highlighted. The method may, as described above, have the highlighting stopped when the change of factor display is stopped, with a highlighting feature identifying at least one selected factor.

In the play of one method of the invention, additional bonus games or bonus rounds may be played, and the additional bonus round or rounds may be additive or again factored with the award of the first bonus round. The probability of specific factors may be different in the play of the second or third bonus event. For example, the probability for higher factors may be greater in the play of the first bonus game may be higher or lower than the probability for higher factors in the second or third bonus game.

The method may be played so that the play of the second bonus game or second bonus segment randomly determines a factor by highlighting one or more factors from a group of factors. The highlighting is preferably random, although sequential movement of the highlighting (e.g., moving to each consecutive higher number in FIGS. 2 and 3) is useful in the practice of the invention. The second bonus round that ordinarily randomly determines a factor, symbols may be displayed that award at least one bonus feature selected from the group consisting of extra play(s) or a factor plus extra play(s). These extra plays would use the amount of the previous wager as a base amount, but would not place that amount at risk. The player could therefore double down or split cards that would not usually be played with that strategy to maximize his winning (e.g., split tens, double down on a count of four, etc.). The method may also include a scoring sequence for at least two bonus rounds. That is, the game allows for addition or storage and/or identification of amounts won or retained during a sequence or a specific sequence of bonus games. The scoring sequence is preferably for 2 to 5 bonus rounds. The bonus play may be triggered by the appearance of, for example, specific preselected events in play of the base casino table card game. The number of bonus games may be awarded in play of the first casino table card wagering game in proportion to the difficulty or frequency of each trigger event occurring.

The method may be practiced wherein a spin button (e.g., button 12 in FIG. 1) is engaged by a dealer to activate each bonus round, or the display of panels is automatically displayed in visual display 14 by computer 4 or activation of dealer input keys 20, wherein the keys communicate with the microprocessor. There may be multiple bonus rounds, and between each of the rounds in the multiple bonus rounds, symbols may be blanked out. That is, when moving from one bonus round to another or even during the play of a single bonus round, there may be no continuous display of any single symbol or frame or no continuous display of alternating symbols within any frame of the panel. The factors or bonus awards including multipliers may be selected from the group consisting of equal to 0 or more. In one form of the invention, the bonus wager should not be placed at risk.

Another preferred feature of the game of the present invention is that the bonus screen may include additional symbols that serve special functions. One such special symbol entitles the player to a free play or a multiplier plus a free play, for example, using the amount of the previous wager as the bonus play of the casino table card game as the wager amount, without that wager being placed at risk. Another special symbol entitles the player to move a predetermined number of adjacent spaces (for example, two spaces) in a single direction to select a new multiplier or special symbol. This would offer the player an opportunity to select a different factor amount. This 'selection' would still be controlled by the random number generator and algorithms, so that the options are random and involve no real skill (e.g., it would be obvious to move from a factor of one to a factor of 100). In one other embodiment, yet another special symbol would allow the player to exchange a lower multiplier plus a free spin for a higher multiplier. An additional special symbol, such as a Big Bucks symbol, functions to provide the player with the highest ranking multiplier or an intermediate multiplier displayed on the bonus game display when the special symbol is randomly selected. In addition, a whammy symbol may be present that causes the player to lose his bonus bet and optionally terminate additional bonus play.

In order to enhance the excitement the game and provide the player with some sense of control over game outcomes, an oversized spin-stop button or Press button 12 may be provided. Preferably, the dealer activates the initiation of a bonus spin, and the player activates stoppage by pressing this button 12. The button is also pressed to initiate the random selection of a bonus game symbol, such as a special function symbol or multiplier. As the excitement and anticipation of bonus wins increases, the players will tend to hit the button harder.

It is to be understood that the examples of the invention described above are merely examples, and that other embodiments of the invention are contemplated.

What is claimed:

1. A method of playing a casino table card game with a bonus event comprising:

a player placing a first wager on a casino table card game;

providing a hand of cards to the player;

determining if the hand of cards provided to a player is within a definition of specific triggering events;

if the hand is determined to be within the definition of specific triggering events, allowing the player to enter a bonus game;

the player enters at least one bonus game where a random symbol is displayed on a visual display device associated with the casino table, the random symbol selected from the group consisting of: an absolute amount, a factor; a maximum payout symbol, a maximum payout factor, extra round(s), extra round(s) plus a factor and move at least one space in a predetermined direction, wherein when the random symbol is a factor, the factor is applied to one or more of: the first wager, a separate side bet wager, payout on the casino table card game or a combination thereof.

2. The method of claim 1 wherein the bonus game randomly awards a multiplying factor to be applied to a separate side bet wager to determine a bonus award.

3. The method of claim 1 wherein the player must place a side bet wager for the player's hand to be determined within the definition of a specific triggering event.

4. The method of claim 1 wherein the casino table card game comprises a game of twenty-one.

5. The method of claim 1 wherein the specific triggering event is a single hand of cards with at least a specific rank.

6. The method of claim 1 wherein the specific triggering event is a sequence of hands with at least specific ranks.

7. The method of claim 4 wherein the specific triggering event comprises a blackjack.

8. The method of claim 2 wherein the casino table card game comprises a game of twenty-one.

9. The method of claim 3 wherein the casino table card game comprises a game of twenty-one.

10. The method of claim 8 wherein the specific triggering event comprises a blackjack.

11. The method of claim 2 wherein the factor is applied in a manner selected from the group consisting of a) a wager placed to participate in said casino table card game, b) an amount won in play of the first casino table card game, and c) an amount won in play of the first casino table card game, less said wager placed to participate in said game.

12. The method of claim 1 wherein the at least one bonus game where a random symbol is displayed on a visual display device associated with the casino table comprises at least two bonus games.

13. The method of claim 12 wherein a second bonus game of said second gaming segment is substantially the same as the first bonus game.

14. The method of claim 12 wherein there is a compulsory second and third bonus game, and the third bonus game is substantially the same as the first bonus game.

15. The method of claim 1 wherein during play of the one bonus game where a random symbol is displayed on a visual display device associated with the casino table, at least one factor area is highlighted on the visual display device.

16. The method of claim 1 wherein during play of the one bonus game where a multiplicity of frames are displayed on a visual display device associated with the casino table, and frames are alternatively highlighted and not highlighted on the visual display device.

17. The method of claim 15 wherein at least some of the random symbols identify factors.

18. The method of claim 17 wherein values of factors are changed on the visual display device during play of the bonus game, but before final selection of a random factor.

19. The method of claim 16 wherein the change between highlighting and not highlighting is stopped, with a highlighting feature identifying at least one factor.

20. An apparatus for playing a live casino table card game with a bonus game comprising:

a casino table with player locations;

a microprocessor operatively connected to the table;

a video display device associated with the table for displaying video information to players at the table;

the computer containing a program to display a collection of symbols;

the symbols being related to identifying an award of at least one award selected from the group consisting of: an absolute amount, a factor, at least one extra bonus event, a maximum payout, a whammy, at least one extra bonus event and a factor, at least one extra bonus event and an absolute amount, a move at least one space in a predetermined direction, wherein a dealer or players having a dealer or player controlled element to initiate display on the display device of an award that is randomly selected by the microprocessor.

21. The apparatus of claim 20 wherein a multiplicity of frames used to identify the award is used to increase the base amount and are displayed on the visual display device associated with the casino table, and frames are alternatively highlighted and not highlighted on the visual display device.

22. The apparatus of claim 20 wherein a separate wagering area is on the table to identify side bet wagers for players to enter a bonus game.

23. The apparatus of claim 22 wherein placing of a side bet wager on the table is indicated at each player position by a visible indicator other than the presence of a token, coinage or chip.

24. The apparatus of claim 23 wherein the visible indicator is activated by a sensor for placement of a wager.

25. The apparatus of claim 20 wherein a spin button is present which is engaged to alter a display on the visual display device.

26. A method of playing a casino table card game with a bonus event comprising:

a player placing a first wager on a casino table card game and an optional wager to participate in a side bet game;

providing a hand of cards to the player;

determining if the hand of cards provided to a player is within a definition of specific triggering events;

if the hand is determined to be within the definition of specific triggering events and the optional wager has been placed, allowing the player to enter a bonus game comprising at least two distinct bonus events;

the player enters at least two consecutively played bonus events wherein at least one randomly selected symbol is displayed in a display device in each bonus event; and resolving all wagers and awards for the player.

27. A method of playing a casino table card game with a bonus event comprising:

a player placing a first wager on a casino table card game;

providing a hand of cards to the player;

determining if the hand of cards provided to a player is within a definition of specific triggering events;

if the hand is determined to be within the definition of specific triggering events, allowing the player to enter a bonus game;

the player enters at least one bonus game where a random symbol is displayed on a visual display device associated with the casino table, the random symbol selected from the group consisting of: an absolute amount, a factor; a maximum payout symbol, a maximum payout factor, extra round(s), extra round(s) plus a factor and move at least one space in a predetermined direction, wherein when the random symbol is a factor, the factor is applied to one or more of: the first wager, a separate side bet wager, payout on the casino table card game or a combination thereof; and resolving all wagers and awards for the player.

* * * * *